United States Patent [19]

Billault

[11] 4,135,890

[45] Jan. 23, 1979

[54] MACHINES FOR SURFACING LENSES

[75] Inventor: Pierre Billault, Bry-sur-Marne, France

[73] Assignee: Essilor International Cie Generale d'Optique, Joinville-le-Pont, France

[21] Appl. No.: 838,358

[22] Filed: Sep. 30, 1977

[30] Foreign Application Priority Data

Oct. 6, 1976 [FR] France ..... 76 30009

[51] Int. Cl.[2] ..... B24B 13/02

[52] U.S. Cl. ..... 51/124 L

[58] Field of Search ..... 51/55, 124 R, 124 L, 51/47, 99, 126

[56] References Cited

U.S. PATENT DOCUMENTS

| | | | |
|---|---|---|---|
| 1,272,546 | 7/1918 | Simpson | 51/124 L |
| 1,671,027 | 5/1928 | George | 51/124 L |
| 2,916,857 | 12/1959 | Dargie | 51/124 L |
| 3,330,075 | 7/1967 | Suddarth | 51/124 L |
| 3,782,042 | 1/1974 | Strasbaugh | 51/124 L |

FOREIGN PATENT DOCUMENTS

| | | | |
|---|---|---|---|
| 2318003 | 7/1975 | France | 51/124 L |
| 129034 | 8/1950 | Sweden | 51/126 |
| 242701 | 9/1969 | U.S.S.R. | 51/55 |

*Primary Examiner*—Nicholas P. Godici
*Attorney, Agent, or Firm*—Charles E. Brown

[57] ABSTRACT

A machine for the surfacing of ophthalmic lenses has a working head in which a supporting finger is axially mounted on a pivotable arm. Pivoting of the arm causes the supporting finger to approach a working station. The arm carries actuating means for the supporting finger which control the approach of the finger towards the working station and control the pressure applied by the finger at the working station. In addition, damping means are provided for damping oscillation and vibrations of said supporting finger.

11 Claims, 4 Drawing Figures

MACHINES FOR SURFACING LENSES

BACKGROUND OF THE INVENTION

The present invention relates to machines for surfacing lenses, and to a working head for such a machine. For example, such a machine can be used to grind and/or polish one or both of the surfaces of a lens, such as an opthalmic lens.

DISCUSSION OF THE PRIOR ART

As is known, an ophthalmic lens surfacing machine generally comprises at least one working station fitted with two blocks adapted to receive between them a lens for surfacing. One of the blocks is arranged to hold the lens and the other of the blocks is arranged to hold a surfacing tool. A working head is associated with the working station. The working head is fitted with a supporting finger which is carried by an arm pivotably mounted on a stationary frame, and the finger is subjected to actuating means arranged to move the finger towards the working station to act upon one of the blocks of the latter. The finger is controlled to apply to said block a specific surfacing pressure.

For surfacing one of the surfaces of a lens disposed between the two blocks of the working station of such a machine, whether the concave surface or the convex surface of said lens is concerned, the blocks in question are actuated relative to each other by a movement with a relatively complex path which is made up of circular and diverse oscillating movements thereby enabling the block bearing the surfacing tool to intervene cyclically at any point of the surface of the lens with which the tool is in contact.

Such a machine is in particular described in U.S. Pat. No. 2,916,857 and in French Patent No. 1,523,358.

The lens surfacing machines described in the above mentioned Patent Specifications are particularly intended for the surfacing of mineral ophthalmic lenses which require, for their surfacing, relatively substantial surfacing pressures, in excess, in practice, of $10^6$ Pascals.

In U.S. Pat. No. 2,916,857 the surfacing pressure is supplied by a spring which is coupled on the one hand to the arm carrying the supporting finger, and on the other hand to the frame of the machine.

In French Patent No. 1,523,358 the surfacing pressure is developed by a pneumatic jack whose piston rod is coupled to the arm carrying the supporting finger and whose body is coupled to the frame of the machine.

Thus, in either case, the supporting finger is rigidly axially connected with the arm which carries it independently of the rotary motion it may have on said arm, and the actuating means which are associated with the finger to permit its actuation upon one of the blocks of the working station concerned act upon it through the pivoting arm which carries it, said actuating means being identical in practice with the operating means associated with said arm to allow it an approach run that is suitable in relation to the said station.

These arrangements are usually satisfactory for the surfacing of mineral ophthalmic lenses which require substantial surfacing pressures as described above.

The same does not apply to the surfacing of ophthalmic lenses of organic material, for which the surfacing pressure must be relatively small, and in practice below $10^6$ Pascals, in the majority of cases between $7.10^5$ and $9.10^5$ Pascals.

It might be thought that known surfacing machines could be simply adapted to produce lower surfacing pressures and thereby be suitable for surfacing ophthalmic lenses of organic material.

However, experience has shown that this solution is not satisfactory.

It has been found that with the relatively low surfacing pressures to be developed in this case, the supporting finger of the working head concerned has a tendency to be subject to axial oscillations which cause defective surfacing of the lens, as a consequence of the chattering of the surfacing tool caused by the oscillations of the finger.

SUMMARY OF THE INVENTION

It is a general object of the invention to provide a machine able to surface ophthalmic lenses of organic material at relatively low surfacing pressures without chattering of the corresponding surfacing tool.

More precisely, it is an object of the invention to provide a working head for a machine for surfacing lenses in which any axial oscillations of the supporting finger are damped.

According to the present invention there is provided a working head for a machine for surfacing lenses, comprising a supporting finger, which is comprehensively axially movably mounted, and which is subject to actuating means adapted to impel it towards a working station, and to damping means, wherein said supporting finger is carried by a pivotably mounted arm, and said actuating means are wholly carried by the said pivotable arm.

As the supporting finger of the working head is axially movable on the pivotable arm which supports it, the actuating means can be wholly carried by the arm and thus be advantageously dissociated from the operating means associated with the arm for moving the arm to provide a suitable approach run towards the working station for the finger.

The surfacing pressure developed by these actuating means can thereby be better controlled.

In addition, and as mentioned above, damping means are associated with the supporting finger for the absorption of the vibrations to which it may be exposed during the surfacing of a lens.

The damping means associated with the supporting finger may be at least partly constituted by the actuating means for the supporting finger.

In practice, according to a preferred embodiment, these actuating means comprise a pneumatic jack having a cylinder which is connected to a buffer reservoir to provide at least a part of the damping means.

In addition, the damping means may comprise resilient means interposed between the piston of this pneumatic jack and the supporting finger upon which said piston is to act.

Tests have shown that such an embodiment works very satisfactorily.

DESCRIPTION OF THE DRAWINGS

An embodiment of the present invention will hereinafter be described, by way of example, with reference to the accompanying drawings in which.

DESCRIPTION OF A PREFERRED EMBODIMENT

Figure 1:
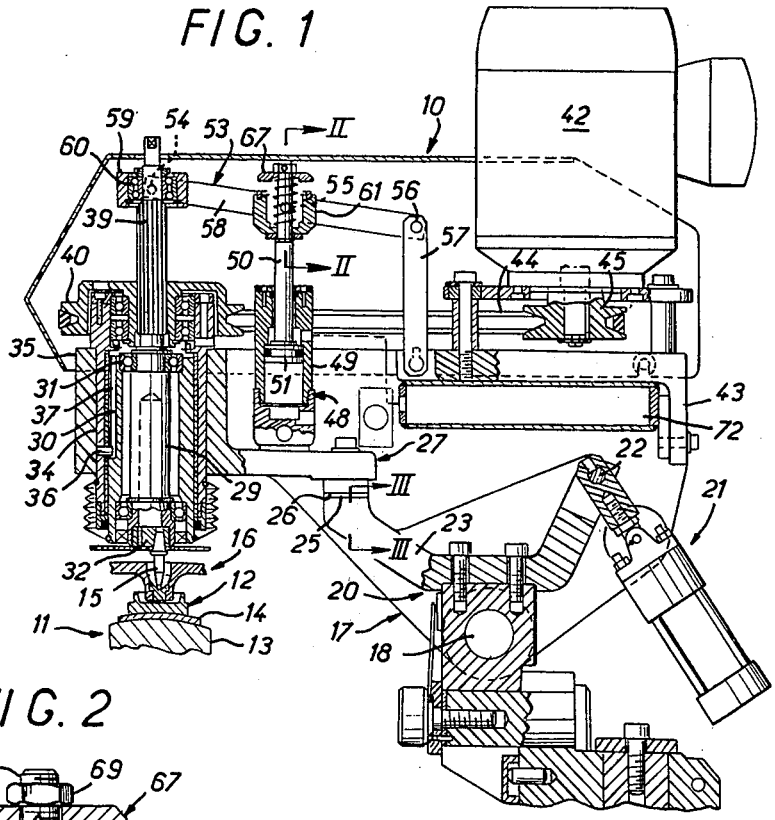
FIG. 1 is a cross-section of a working head for a surfacing machine, and of part of the working station with which the head is associated.
Figure 2:
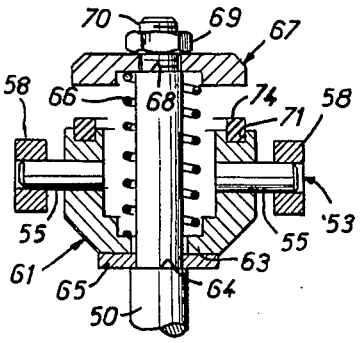
FIG. 2 is, on a larger scale, a partial section of said working head, taken along line II—II of FIG. 1.

As shown in the Figures, the surfacing machine has a working head 10 associated with a working station 11 which is of the type described in the above-mentioned U.S. Pat. No. 2,216,857.

As the working head 11 does not form part of the present invention it will not be described in detail here.

It will suffice to point out that it comprises two blocks 12, 13 adapted to receive between them a lens 14 to be surfaced, the block 12 being adapted to support the lens 14, for example by the provision of glands, whilst the block 13 is adapted to carry a surfacing tool or constitutes in itself such a tool.

In practice, and as described in the above-mentioned U.S. Patent, a supporting finger 15 with which the working head 10 is fitted acts upon the block 12 bearing the lens 14 by way of a clip 16, and the block 13 bearing the tool or constituting the tool is actuated to move relative to the block 12 in a complex path.

The means for obtaining the movement of the block 13 are described in detail in the above-mentioned U.S. Pat. No. 2,216,857 and will not be further described herein.

In a manner known per se, the supporting finger 15 of the working head 10 is supported by an arm 17 pivotably mounted about a shaft 18 which is carried by a frame denoted by the general reference numeral 20 of FIG. 1.

Operating means are associated with the arm 17 to permit the pivoting about the shaft 18.

For example, and as shown, these operating means comprise a jack 21 whose cylinder is pivotably mounted on the arm 17, while its piston is articulated at 22 on a bracket 23 connected to the frame 20.

Whatever the configuration of the operating means, these operating means are arranged to provide, by means of the pivoting of the arm 17 to which they are applied, a suitable approach run for the supporting finger 15 of the working head 10 relative to the working station with which the working head is associated.

Figure 3:
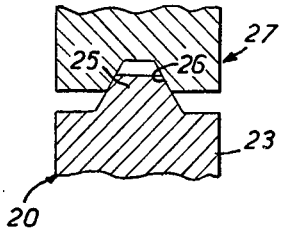
FIG. 3 is another view of the head in part section taken along line III—III of FIG. 1.

For a positive positioning of the arm 17 at the end of this approach run, the bracket 23 of the frame 20 has a V-shaped tenon 25, FIGS. 1 and 3, which cooperates with a complementary mortise 26 provided on the bottom face of a bracket 27 which is rigidly connected to the arm 17.

The supporting finger 15 is, in the example illustrated, carried in an eccentric position by a pin 29 which is rotatably mounted in a bush 30, bearing 31 being interposed between said pin 29 and said bush 30 at each of the ends of the bush.

For example, and as illustrated, the supporting finger 15 is engaged by a force-fit into a block fitted on the end of the pin 29, for example, by screwing.

The bearings 31 are held axially relative to the pin 29 by resilient split rings which engage in throats in the pin 29, the split rings also effecting an axial interlock of the pin 29 relative to the bush 30 in which it is rotatably mounted, by cooperating with shoulders provided for the purpose on the internal surface of the bush 30.

The bush 30 is mounted for axial movement in a tubular casing 34 which is rigidly connected with the arm 17, so that the supporting finger 15, is thus itself mounted on said arm and comprehensively axially movable.

In practice, the casing 34 is engaged in a sleeve 35 carried by the bracket 27 which is rigidly connected with the arm 17, and the casing 34 is locked in said sleeve 35.

The casing 34 carries, on its internal periphery, a lug 36 which engages in a longitudinal groove 37 of the bush 30 whereby the bush 30 is prevented from rotating.

The pin 29 has, at its end remote from the supporting finger 15, a fluted extension 39, by means of which the pin is rotationally engaged with a pulley 40. The arm 17 carries a motor 42 for driving the pulley 40.

In practice, in the example illustrated, the motor 42, which is carried by a bracket 43 rigidly connected with the arm 17, drives a pulley 45. An endless drive belt connects the output pulley 45 of the motor 42 with the pulley 40.

Actuating means are associated with the supporting finger 15 to impel it towards the working station 11.

In the embodiment illustrated such actuating means are, as a whole, carried by the arm 17 to which the supporting finger 15 is fitted, and the supporting finger is in addition subject to damping means.

In practice, in the example illustrated, the actuating means comprise a pneumatic jack 48 whose cylinder 49 is carried by the bracket 27 fixed to the arm 17. A rod 50 of a piston 51 of the jack 48 acts upon the supporting finger 15 by way of resilient means forming part of the damping means to which the supporting finger is subject.

A lever 53 is connected at a point 54 thereof to the pin 29 which carries the supporting finger 15. The piston rod 50 acts on said lever 53 at a second point 55 thereof, whilst at a third point 56 the lever 53 is hinged to a rod 57 rigidly connected to the arm 17.

In practice, in the example illustrated, the lever 53 forms a fork whose two arms 58 encompass, at their free ends, a ring 59 which is axially fixed at the end of the extension 39 of the pin 29, with the interposition of bearings 60.

The ring 59 carries two pins 54 which project radially from its outer periphery in diametrically opposed directions. Each arm 58 of the lever 53 is pivotably mounted on a respective one of the pins 54.

At their central portions, the arms 58 of the lever 53 are, in similar manner, pivotably mounted on pins 55 which project radially, in diametrically opposed directions, from an intermediate member 61 interposed between the lever 53 and the rod 50 of the piston 51.

In the example illustrated, this intermediate member 61 is cup-shaped and the rod 50 passes with some play through a central portion 63 of the cup, that is to say through the base, the external face of said central portion 63 cooperating in abutment with a transverse shoulder 64 of the rod 50, with the interposition of a washer 65 in the example illustrated. The internal face of the portion 63 acts as a support for one end of a spring 66 constituting the resilient means interposed between the rod 50 and the supporting finger 15.

The other end of the spring 66 rests upon a stop abutment 67 which is rigidly connected to the free end of the rod 50.

In practice, in the example illustrated, this abutment 67 is a cup-shaped member held against a shoulder 68 of the rod 50 by means of a nut 69 screwed on a threaded extension 70 of said rod, and the free end surface of the stop 67 faces the free surface of the member 61.

Either of the facing surfaces of the stop 67 and the member 61, and in practice that of the member 61 in the example illustrated, has an annular groove 71 in which a noise damping element 74, for example of elastic material, is housed for a silent operation of the assembly.

At least part of the damping means to which the supporting finger 15 is subject comprises a buffer reservoir 72 which is connected to the cylinder 49 of the pneumatic jack 48 and which is carried by the bracket 43 which is fixed to the arm 17.

A duct 73 connects the reservoir 72 to the cylinder 49 of the jack 48. The duct 73 is connected to the end of said cylinder situated between the piston 51 which it contains and the supporting finger 15, in such a manner that, whatever may be the position of the piston 51, the buffer reservoir 72 contributes to the pneumatic volume controlling the supporting finger 15.

Figure 4:
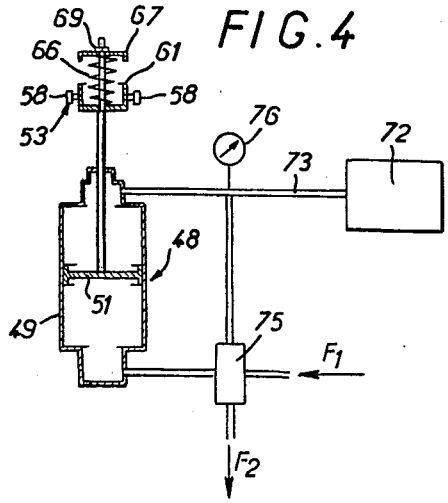
FIG. 4 is a block diagram illustrating the actuating means and the damping means associated with a supporting finger of said working head.

A distributor 75 of any type is provided, for controlled connection of one or the other end of the cylinder 49 of the jack 48 with a source of compressed air, such as represented diagrammatically by the arrow $F_1$ in FIG. 4, or with a discharge, such as diagrammatically represented by the arrow $F_2$ of said FIG. 4.

A pressure gauge 76 is provided to control the pressure of the pneumatic volume the cylinder 49 to which the buffer reservoir 72 contributes.

As mentioned above, the jack 21 acts to pivot the arm 17 to provide a suitable approach run, relative to the working station 11, of the supporting finger 15 which is carried by the arm 17.

To complete this approach run, and then to ensure the application of a suitable surfacing pressure to blcoks 12, 13 by the supporting finger 15, it is sufficient, by means of the distributor 75, to place the end of the cylinder 49 of the jack 48 which is between the piston 51 and the supporting finger 15, in connection with a source of compressed air. The piston 51 then applies a downward force on the rod 50 as seen in FIG. 1, and the spring 66 resiliently transmits a corresponding force to the lever 53, said force being then transmitted in turn to the pin 29, and thus to the supporting finger 15, independently of the circular movement of which the latter is the subject as a consequence of the rotational control applied to it from the motor 42.

Any oscillations and vibrations to which, in operation, the supporting finger may be subject during the surfacing of a lens 14 are then jointly damped on the one hand by the pneumatic volume to which the buffer reservoir 72 contributes, and on the other hand by the spring 66 interposed between said supporting finger and the piston 51 which impels it towards the working station 11.

Preferably, the damping force due to the spring 66 is slightly less than the force due to the pneumatic volume to which the buffer reservoir 72 contributes at the minimum supply pressure of the jacks 48.

Thus, the spring 66 effects in practice only compensation for the small oscillations to which the supporting finger 15 may be subject, while the pneumatic volume to which the buffer reservoir 72 contributes resiliently compensates more considerable oscillations of said supporting finger 15.

This is moreover the reason why such a buffer reservoir 72 is associated with the cylinder 49 of the jack 48, the volume of said cylinder not being in itself sufficient to effect the desired compensation of oscillations.

It will have been noted that, in the embodiment illustrated, the pneumatic jack 48 forms part of both the actuating means for the supporting finger 15, and the damping means associated with said supporting finger, and that it is separate from the jack 21 associated with the pivoting arm 17.

Naturally, the present invention is not restricted to the embodiment described and illustrated and alternative constructions are possible.

For example, the intermediate member 61, could be an ordinary clip instead of the cup-shaped member illustrated.

In addition, the noise damping element 74 which is carried by the member 61 could equally well be placed on the abutment stop 67.

Moreover, the range of application of the invention is not limited to a working station 11 of the type described in U.S. Pat. No. 2,916,857. The working station could be of any other type, for example, of the type described in French Patent No. 1,523,358.

Indeed, it does not matter if the supporting finger 15 bears on either of the blocks 12, 13 that is to say on the block which supports the lens to be surfaced, as in the above-mentioned U.S. Patent, or on the block which carries the tool or constitutes a tool, as in the French patent also mentioned above.

As regards the spring 66, this may be a spring made from a material with variable elasticity, in such a manner as to improve still further the damping of any oscillations and vibrations.

Finally, the invention applies both to the surfacing of spherical lenses and to the surfacing of toric lenses.

I claim:

1. A working head for a machine for surfacing lenses, said working head comprising a pivotally mounted arm, a supporting finger generally axially movably mounted on said arm, actuating means wholly carried by said arm and arranged to urge said supporting finger towards a working station, said actuating means comprising a pneumatically controlled piston slidable within a cylinder and resilient means, a casing rigidly fixed to said pivotally mounted arm, a pin mounted within said casing and being axially slidable with respect to said casing, said pin carrying said supporting finger, and a lever, a first point of said lever being coupled to said pin, a second point of said lever being operatively connectable to said piston and a third point of said lever being hingedly connected to said pivotable arm, and said resilient means being operative between said piston and said lever.

2. A working head according to claim 1, further comprising an intermediate member hingedly connected to said second point of said lever, said intermediate member having a substantially U-shaped cross-section and having an aperture through which a piston rod of said piston extends, a transverse shoulder on said rod arranged to cooperate with said intermediate member, an abutment connected to the free end of said piston rod so that a surface of said abutment faces the external surface of said intermediate member, and said resilient means includes a spring interposed between an internal surface of said intermediate member and said abutment.

3. A working head according to claim 2, wherein a damping element is interposed between said intermediate member and said abutment.

4. A working head according to claim 3, wherein said damping element is carried on the internal surface of the intermediate member which faces said abutment.

5. A working head according to claim 3, wherein said damping element is carried on the surface of the abutment which faces the internal surface of the intermediate member.

6. A working head according to claim 1, wherein a buffer reservoir is connected to said cylinder associated with said pneumatically controlled piston.

7. A working head according to claim 1 wherein said resilient means is part of damping means for damping oscillations and vibrations of said supporting finger.

8. A machine for surfacing lenses, said machine comprising at least one working station comprising two blocks adapted to receive between them a lens to be surfaced, one of said blocks being arranged to support the lens, the other of said blocks carrying a surfacing tool; the machine further comprising a working head associated with said working station, said working head comprising a fixed frame, an arm pivotably mounted on said fixed frame, a supporting finger generally axially mounted on said arm, actuating means wholly carried by said arm and arranged to urge said supporting finger towards a working station, said actuating means of said working head comprising a pneumatically controlled piston slidable within a cylinder and resilient means, a casing rigidly fixed to said pivotably mounted arm, a pin mounted within said casing and being axially slidable with respect to said casing, said pin carrying said supporting finger, and a lever, a first point of said lever being coupled to said pin, a second point of said lever being operatively connectable to said piston, and a third point of said lever being hingedly connected to said pivotable arm, and said resilient means being operative between said piston and said lever.

9. A machine according to claim 8, wherein the working head further comprises an intermediate member hingedly connected to said second point of said lever, said intermediate member having a substantially U-shaped cross-section and having an aperture through which a piston rod of said piston extends, a transverse shoulder on said rod arranged to cooperate with said intermediate member, an abutment connected to the free end of said piston rod so that a surface of said abutment faces the external surface of said intermediate member, and said resilient means include a spring interposed between an internal surface of said intermediate member and said abutment.

10. A machine according to claim 8 wherein a buffer reservoir is connected to said cylinder associated with said pneumatically controlled piston.

11. A working head according to claim 8 wherein said resilient means is part of damping means for damping oscillations and vibrations of said supporting finger.

* * * * *